US005077926A

United States Patent [19]

Krumm

[11] Patent Number: 5,077,926

[45] Date of Patent: Jan. 7, 1992

[54] GUN BARREL EQUIPPED WITH OPTIMIZED RIFLING

[75] Inventor: Herbert Krumm, Kaarst, Fed. Rep. of Germany

[73] Assignee: Rheinmetall GmbH, Düsseldorf, Fed. Rep. of Germany

[21] Appl. No.: 641,782

[22] Filed: Jan. 16, 1991

[30] Foreign Application Priority Data

Jan. 17, 1990 [DE] Fed. Rep. of Germany ..... 4001130

[51] Int. Cl.[5] ..... F41A 21/16

[52] U.S. Cl. ..... 42/78; 29/1.1

[58] Field of Search ..... 29/1.1; 42/78

[56] References Cited

U.S. PATENT DOCUMENTS 3,525,172 8/1970 Marshall et al. ..... 42/78

4,176,487 12/1979 Manis ..... 42/78

FOREIGN PATENT DOCUMENTS 2156055 10/1985 United Kingdom ..... 42/78

OTHER PUBLICATIONS

*Handbook on Weaponry*, Rheinmetall GmbH, 2nd English edition, 1982, pp. 572–579; and German language version, 5th edition, 1980, pp. 524–525.

*Primary Examiner*—Deborah L. Kyle

*Assistant Examiner*—Richard W. Wendtland

*Attorney, Agent, or Firm*—Spencer & Frank

[57] ABSTRACT

In order to improve the service life of prior art gun tubes and to improve the ballistics of a projectile fired through them, the present invention provides a gun tube with an optimized variable rifling which produces a rifling force curve (R(x)) along the gun tube (x) which has an essentially trapezoidal shape with a noticeably reduced rifling force maximum compared to the rifling force curves of conventional constant rifling.

4 Claims, 1 Drawing Sheet

GUN BARREL EQUIPPED WITH OPTIMIZED RIFLING

CROSS REFERENCE TO RELATED APPLICATIONS

The present application claims the rights of priority of Application Serial No. P 40 01 130.5, filed Jan. 17th, 1990, in the Federal Republic of Germany.

BACKGROUND OF THE INVENTION

The present invention relates to a gun tube provided with rifling for producing a rifling force which becomes active when a projectile is fired from the gun tube.

The service life of such rifled gun barrels is known to depend significantly on the rifling force. This relationship, along with the design of a profile composed of grooves and lands and a corresponding development of spin in the gun tube, is explained and described in detail in *HANDBOOK ON WEAPONRY*, published by Rheinmetall GmbH, 2nd English Edition, 1982, pages 572 to 579. Accordingly, the rifling force R(x) along the path of the projectile x in the longitudinal direction of the gun tube can be described, in a good approximation, as follows:

$$R(x) \approx \frac{4 \cdot J}{D^2 \cdot m_G}\left[\frac{dy}{dx} \cdot p(x) + \frac{d^2y}{dx^2} \cdot v_G^2 \cdot m_G\right]$$

under the condition that:

$$\frac{dy}{dx} = \tan \alpha(x) \text{ and } \frac{d^2y}{dx^2} = \frac{d\alpha(x)}{dx} \cdot \frac{1}{\cos^2 \alpha(x)}$$

where

J is the moment of inertia of the projectile about its longitudinal axis;

D is the caliber of the gun tube;

$m_G$ is the mass of the projectile;

y is the developed circumferential direction;

p(x) is the gas pressure acting ont he projectile base;

$v_G(x)$ is the velocity of the projectile;

$\alpha(x)$ is the rifling angle.

This makes it clear that with a given projectile mass $m_G$, projectile velocity $v_G(x)$ and gas pressure curve p(x), the character of the rifling of the gun barrel under consideration decisively influences the rifling force curve R(x).

However, it is a disadvantageous fact that in the constant twist design which has been employed most frequently for manufacturing technology reasons, particularly in large caliber gun tubes, in which the rifling angle $\alpha(x)$ is independent of the projectile path x, the rifling force curve R(x) is proportional to the gas pressure curve p(x). A distinct, local maximum of the rifling force occurs which coincides in its location in the gun barrel with the gas pressure maximum and leads to undesirably high, local stresses.

Some time ago, calculations were made in an attempt to reduce the rifling force by employing a parabolic, sinusoidal or cubic-parabolic rifling, as described in the above mentioned *HANDBOOK ON WEAPONRY*. These types of rifling, particularly those identified as progressive in FIG. 1137 at page 575 the *HANDBOOK ON WEAPONRY*, show that with parabolic and cubic-parabolic rifling, a high rifling force R(x) occurs at the muzzle end of the gun tube and may adversely influence the trajectory of the projectile. Moreover, it has a torsional impulse effect on the gun tube and thus generates undesirable vibrations of the gun tube about its bore axis, putting additional stress on the projectile.

As can also be seen in the above mentioned FIG. 1137 of the *HANDBOOK ON WEAPONRY*, the sinusoidal rifling still shows a distinct maximum of rifling force but also a clearly reduced rifling force at the muzzle end of the gun tube. Since, however, in the prior art gun tubes provided with cubic parabolic rifling for automatic cannons, the rifling angle $\alpha(x)$ increases from an initial rifling angle $\alpha_A=0°$ to a final rifling angle $\alpha_E=6.5°$ at the gun tube muzzle, the advantage realized by the lower rifling force at the muzzle is in part consumed by the distinct reshaping of the rotating band of the projectile. These relationships become less favorable, the broader the rotating band.

For artillery tubes whose projectiles customarily have particularly wide rotating bands, a progressive rifling angle curve beginning with an initial twist $\alpha_A=0°$ increases the stress on the rotating bands, particularly if the customary final rifling angle of $\alpha_E \approx 9°$ is to be realized. In this case, almost the entire width of the rotating band is reshaped by the change in rifling angle so that the danger exists that the rotating band might fail in the gun tube.

SUMMARY OF THE INVENTION

It is therefore an object of the present invention to avoid the above-described drawbacks of the prior art types of rifling employed in gun tubes and to improve the service life of the gun tube as well as the internal and external ballistics of projectiles fired from it with a reduced rifling force maximum by the provision of a gun tube whose rifling character has been improved.

The above and other objects are accomplished in the context of a gun tube having a length x and an inside wall provided with rifling and producing a rifling force (R(x)) which is active on a projectile fired from the gun tube, wherein according to the invention the rifling is provided with a variable rifling angle $\alpha(x)$ which varies in a manner to produce a rifling force (R(x)) along the path of the projectile through the gun tube which, with a given projectile mass ($m_G$), projectile velocity ($v_G(x)$) and gas pressure curve (p(x)), increases steeply at the beginning of the rifling, remains essentially constant over a subsequent further region of the gun tube and drops steeply toward the gun tube muzzle such that a curve of the rifling force (R(x)) essentially describes a trapezoidal shape, with the maximum of the rifling force (R(x)) being reduced by at least one quarter compared to a corresponding gun tube provided with a conventional constant rifling.

The particular advantage of a gun tube designed according to the present invention is that a locally distinct maximum of rifling force is avoided and the maximum rifling force that does occur is noticeably reduced so that the entire groove-and-land profile is subjected to reduced stresses and thus the service life of the gun tube with respect to fatigue and wear is improved.

Another advantage of the gun tube according to the invention is that, as in a preferred embodiment of the invention, it is provided that a rifling angle described by a higher order Fourier series makes possible a corresponding adaptation of the desired rifling force curve to the given gas pressure curve by means of a sufficient number of coefficients. By numerically optimizing the coefficients of the Fourier series in a known manner, it is possible to precisely set the rifling force at the gun tube muzzle, to noticeably reduce the rifling force maximum, and set a smaller change in rifling angle along the projectile path in order to protect the rotating band of the projectile.

The invention will now be described in greater detail by way of a preferred embodiment in the form of an artillery tube of 155 mm caliber and a gun tube length of 52 calibers.

To facilitate understanding and clarify the invention, the detailed description is provided in conjunction with the following drawings.

DETAILED DESCRIPTION OF THE PREFERRED EMBODIMENT

The preferred embodiment of the invention uses the following linear Fourier series to obtain the desired rifling angle curve $\alpha(x)$ for an artillery gun tube of a caliber of D=155 mm and a gun tube length x of $0 \leqq x \leqq 52 \cdot D$, based on a given gas pressure curve p(x) and a given projectile velocity $v_G(x)$.

$$\alpha(x) = \Sigma C_n \cdot \cos(n \cdot x \cdot \pi \cdot f / x_E); 0 \leqq n \leqq 10$$

For ballistic reasons, the final rifling angle $\alpha_E$ at the gun tube muzzle is $\alpha_E = 8.969°$. In order to obtain favorable conditions at the beginning of the rifling $x = x_A$ and at the end of the rifling $x = x_E$ similar to the prior art constant rifling, the rifling curve $\alpha(x)$ at these locations $x_A$ and $x_E$ must have an almost horizontal tangent so that the following applies:

$$\frac{d\alpha}{dx} = -\frac{f \cdot \pi}{x_E} \Sigma\, n \cdot C_n \cdot \sin(n \cdot \pi \cdot x \cdot f / x_E) \approx 0$$

The factor f in the argument of the trigonometric terms of the above Fourier series serves to shorten the period and therefore influences the rifling force R(x) at the muzzle of the gun tube $x = x_E$. Preferably, the following applies for factor f:

$$1.0 < f < 1.2$$

Another important parameter for influencing the rifling force R(x) is the initial rifling angle $\alpha(x)$ at $x_A$.

Figure 1:
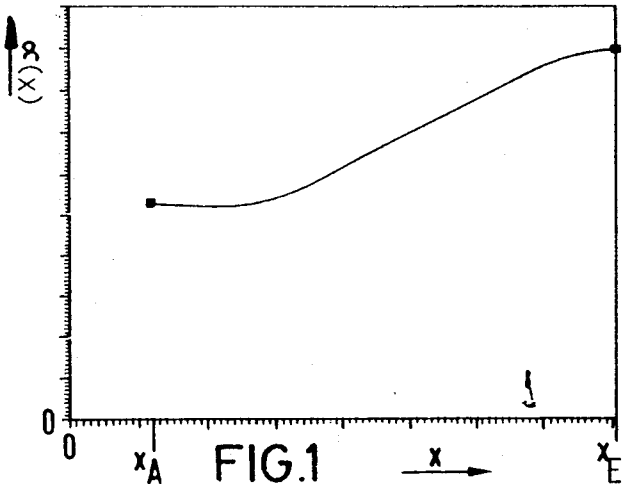
FIG. 1 is a diagram of a rifling angle $\alpha(x)$ plotted over a gun tube length x of a gun tube according to the invention in the interval between positions $x_A$ and $x_E$ marked on the abscissa.

The diagram of the rifling force $\alpha(x)$ of a gun tube according to the present invention shown in FIG. 1 is based, in addition to the values mentioned above, on the following coefficients which are determined with the aid of a known numerical optimization method:

| | | | |
|---|---|---|---|
| $\alpha_A =$ | 5.298° | $\overset{\cap}{\alpha}_A =$ | 0.0925 |
| $C_1 =$ | −1.82927 | $C_6 =$ | 0.02020 |
| $C_2 =$ | 0.22474 | $C_7 =$ | 0 |
| $C_3 =$ | 0 | $C_8 =$ | 0.00117 |
| $C_4 =$ | 0.10200 | $C_9 =$ | 0 |
| $C_5 =$ | 0.01480 | $C_{10} =$ | 0.00001 |

With the above mentioned derivation $$\frac{d\alpha}{dx} = -\frac{f \cdot \pi}{x_E} \Sigma\, n \cdot C_n \cdot \sin(n \cdot \pi \cdot x \cdot f / x_E) \approx 0$$

and the relationships $$\frac{dy}{dx} = \tan \alpha(x) \text{ and } \frac{d^2y}{dx^2} = \frac{d\alpha(x)}{dx} \cdot \frac{1}{\cos^2 \alpha(x)}$$

and a given gas pressure curve p(x) and projectile velocity curve $v_G(x)$, the rifling force R(x) along the tube is defined as follows:

$$R(x) \approx \frac{4 \cdot J}{D^2 \cdot m_G} \left[ \frac{dy}{dx} \cdot p(x) + \frac{d^2y}{dx^2} \cdot v_G^2 \cdot m_G \right]$$

Figure 2:
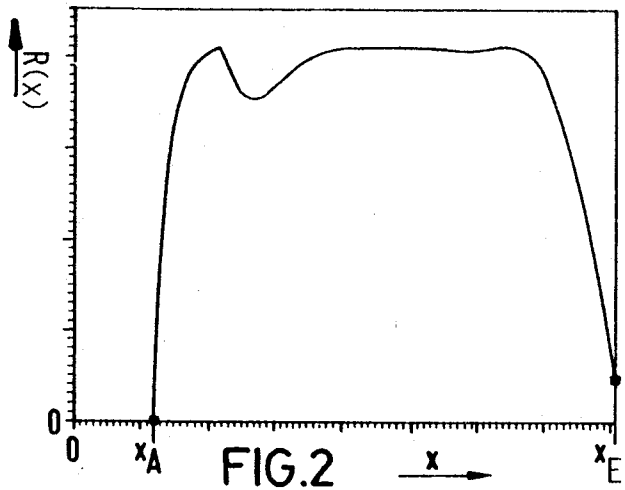
FIG. 2 is a diagram of the rifling force R(x) resulting from the rifling angle curve $\alpha(x)$ of FIG. 1 plotted over the length x of the gun tube.

A rifling force R(x) determined in this manner is shown in the diagram of FIG. 2.

On the basis of the selected final rifling angle of $\alpha_E = 8.969°$, a large initial rifling angle of $\alpha(x_A) = 5.298°$ results. The thus obtained change in rifling angle along the tube from $\Delta\alpha = \alpha_E - \alpha_A = 3.6289°$ is advantageously very small so that a conventional rotating band is deformed only slightly on its path through the gun barrel. In general, it is desirable that $\Delta\alpha < 5.5°$. FIG. 2 shows that the maximum of the rifling force R(x) remains essentially constant over the projectile path x through the gun tube.

Another advantage is the small initial rifling angle of $\alpha_A = 5.298°$ as determined according to the invention since it has a favorable influence on the so-called torsional impulse effect and thus reduces the tendency of the gun tube to vibrate.

Figure 3:
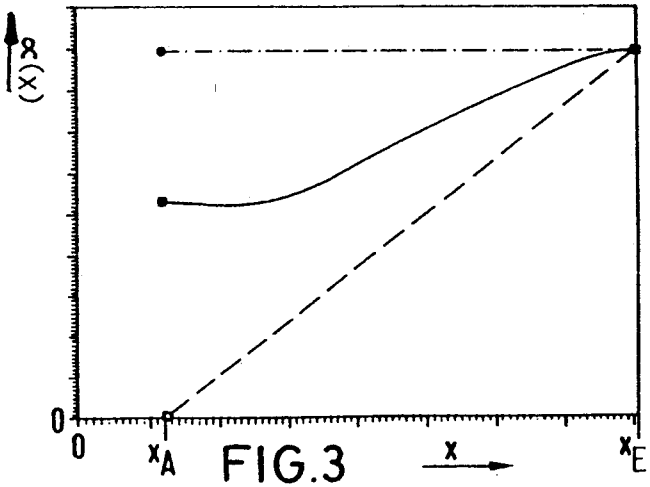
FIG. 3 is a diagram of the rifling angle curve according to the present invention as shown in FIG. 1 and the rifling angle curves $\alpha(x)$ for constant rifling and parabolic rifling in a corresponding gun tube for purposes of comparison.

For purposes of clarification, FIG. 3 shows the rifling angle curve $\alpha(x)$ according to the invention which here, as in FIG. 1, is shown as a solid line, compared to the types of rifling employed in the past for a corresponding gun tube. In FIG. 3, the constant rifling is shown as a dash-dot curve and the parabolic rifling as a dashed curve.

Figure 4:
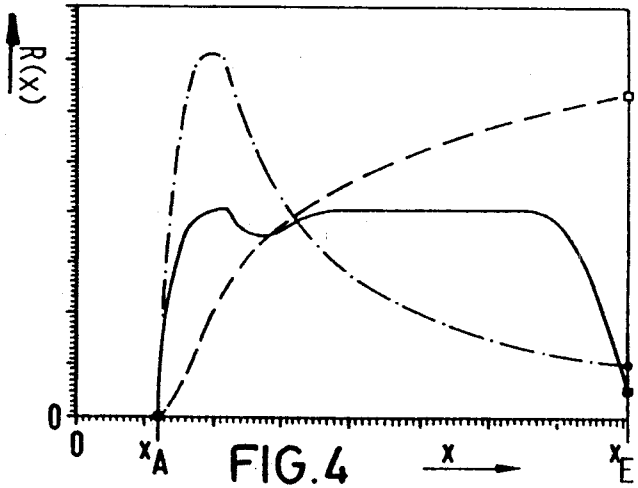
FIG. 4 is a diagram (to a smaller scale than FIG. 2) of the rifling forces R(x) resulting from the rifling angle curves $\alpha(x)$ of FIG. 3.

Based on the rifling angle curves $\alpha(x)$ shown in FIG. 3, there result the rifling force curves R(x) shown in FIG. 4 for the respective types of rifling. In FIG. 4 the curves are displayed in the same manner as in FIG. 3.

FIG. 4 clearly shows that, compared to the constant rifling still customary in artillery gun tubes, the rifling force maximum of a gun tube according to the present invention has been reduced by about 42%.

With the parabolic rifling presently customary in automatic cannons, which has here been transferred, for purposes of comparison, to an artillery gun tube shown as an example for the present invention, a gun tube constructed according to the present invention would produce a reduction of the rifling force maximum by only about 11%, but the parabolic rifling would greatly deform the rotating band of a projectile while it passes from $x_A$ to $x_E$ because of $\Delta\alpha \approx 9°$ and could possibly cause the rotating band to fail. Moreover, with parabolic rifling, the rifling force $R(x_E)$ takes on its maximum at the muzzle so that a surge of torque is exerted on the exiting projectile which, under certain circumstances, may interfere with its take-off.

In contrast thereto, the rifling force $R(x_E)$ at the muzzle of the gun tube according to the present invention, as shown in FIG. 4, amounts to only 10% of its maximum value.

In summary, the following advantages result with the gun tube according to the present invention compared to the prior art gun tubes having conventional rifling designs:

- less stress on the groove-land profile of the rifling, that is less wear of the gun tube and better intrinsic fatigue resistance;
- less stress on the rotating band of the projectile;
- less stress on the spin absorption faces;
- less excitation of gun tube vibrations;
- favorable take-off ballistics of the projectile due to reduced rifling force at the gun tube muzzle;
- slight deformation of the rotating band on the projectile due to less change in the rifling angle during passage of the projectile through the gun tube.

The manufacture of gun tubes according to the present invention, even of large caliber, according to the above discussed rifling principles, is possible today without great difficulties by means of CNC [computerized numerical control] groove drawing machines.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A gun tube having a length x and an inside wall provided with rifling and producing a rifling force (R(x)) which is active on a projectile fired from the gun tube, the improvement wherein:

the rifling has a variable rifling angle $\alpha(x)$ which varies in a manner to produce a rifling force (R(x)) along the path of the projectile through the gun tube which, with a given projectile mass ($m_G$), projectile velocity ($v_G(x)$) and gas pressure curve (p(x)), increases steeply at the beginning of the rifling, remains essentially constant over a subsequent further region of the gun tube and drops steeply toward the muzzle such that a curve of the rifling force (R(x)) essentially describes a trapezoidal shape, with the maximum of the rifling force (R(x)) being reduced by at least one quarter compared to a corresponding gun tube provided with a conventional constant rifling, and wherein the rifling angle ($\alpha(x)$) determining the rifling force (Rx)) is described by a Fourier series as follows:

$$\alpha(x) = \Sigma S_n \cdot \sin(n \cdot F \cdot x) + C_n \cdot \cos(n \cdot F \cdot x); \text{ where } 0 \leqq n \leqq z,$$

n and z are positive integer values and F is a constant factor.

2. A gun tube as defined in claim 1, wherein the Fourier series determining the rifling angle ($\alpha(x)$) is a linear Fourier series.

3. A gun tube as defined in claim 2, wherein the constant factor (F) in the argument which determines the rifling angle ($\alpha(x)$) of the gun tube in the trigonometric terms of the Fourier series is described by $F = \pi f / x_E$, where f is a factor for influencing the rifling force (R(x)) at the muzzle end of said gun tube and $1.0 < f < 1.2$.

4. A gun tube as defined in claim 3, wherein, in order to protect the rotating band of the projectile, a change ($\Delta\alpha$) in the rifling angle ($\alpha(x)$) from an initial rifling angle $\alpha_E$ ($\alpha_A = \alpha(x_A)$) at the beginning of the rifling to a final rifling angle ($\alpha_E = \alpha(x_E)$) at the muzzle is less than 5.5° so that the following applies:

$$\Delta\alpha = \alpha_E - \alpha_A < 5.5°.$$

* * * * *